US008974265B2

(12) United States Patent
Wallace

(10) Patent No.: US 8,974,265 B2
(45) Date of Patent: Mar. 10, 2015

(54) SELF-RIGHTING MECHANISM FOR A RADIO-CONTROLLED CAR

(75) Inventor: Matthew S. Wallace, Redlands, CA (US)

(73) Assignee: D.T. Mattson Enterprises, Inc., Banning, CA (US)

( * ) Notice: Subject to any disclaimer, the term of this patent is extended or adjusted under 35 U.S.C. 154(b) by 391 days.

(21) Appl. No.: 13/429,055

(22) Filed: Mar. 23, 2012

(65) Prior Publication Data

US 2013/0252510 A1 Sep. 26, 2013

(51) Int. Cl.
*A63H 17/26* (2006.01)
*A63H 29/16* (2006.01)
*A63H 17/00* (2006.01)

(52) U.S. Cl.
CPC ..... *A63H 17/262* (2013.01); *A63H 17/004* (2013.01)
USPC ..... 446/437; 446/176

(58) Field of Classification Search
CPC ... A63H 17/00; A63H 17/002; A63H 17/004; A63H 17/02; A63H 17/06
USPC ..... 446/176, 396, 431, 437, 441, 465
See application file for complete search history.

(56) References Cited

U.S. PATENT DOCUMENTS 1,846,823 A * 2/1932 Westberg ..... 446/437
2,189,759 A * 2/1940 Lohr et al. ..... 446/290
3,892,086 A * 7/1975 Gay et al. ..... 446/486
4,300,308 A 11/1981 Ikeda
4,363,187 A * 12/1982 Shinohara ..... 446/437
4,490,124 A * 12/1984 Ogawa ..... 446/464
4,591,346 A * 5/1986 Ikeda ..... 446/437
4,702,720 A 10/1987 Konta et al.
4,894,042 A * 1/1990 Kamikawa ..... 446/437
4,911,669 A * 3/1990 Parker ..... 446/6
4,998,903 A * 3/1991 Bolli et al. ..... 446/102
5,100,138 A * 3/1992 Wilde ..... 273/440.1
5,259,808 A * 11/1993 Garr ..... 446/437
5,322,469 A 6/1994 Tilbor
5,474,486 A * 12/1995 Chilton et al. ..... 446/456
5,482,494 A 1/1996 Ishimoto
5,727,986 A * 3/1998 Stubenfoll et al. ..... 446/437
5,735,727 A * 4/1998 Tsai ..... 446/462
5,785,576 A 7/1998 Belton
5,803,790 A * 9/1998 Tilbor et al. ..... 446/470
6,129,607 A * 10/2000 Hoeting et al. ..... 446/396

(Continued)

FOREIGN PATENT DOCUMENTS

WO WO 00-07682 2/2000

*Primary Examiner* — Gene Kim
*Assistant Examiner* — Alyssa Hylinski
(74) *Attorney, Agent, or Firm* — Christie, Parker & Hale, LLP

(57) ABSTRACT

A self-righting mechanism for a toy vehicle includes a base configured to be coupled to the vehicle; an actuator rotatably coupled to the base and extending generally toward a top of the vehicle, the actuator comprising a housing and an actuating rod, wherein the actuator has an inactivated position in which the actuating rod extends a first distance from the housing and an activated position in which the actuating rod extends a second distance from the housing greater than the first distance; an arm rotatably coupled to the base and rotatably coupled to the actuator; and a cartridge containing a pressurized gas coupled to the actuator, wherein the actuator is configured to be moved from the unactivated position and the activated position by the pressurized gas and wherein when the actuator is in the activated state, the arm protrudes from the vehicle.

13 Claims, 4 Drawing Sheets

(56) References Cited

U.S. PATENT DOCUMENTS

| | | | | |
|---|---|---|---|---|
| 6,227,934 | B1 | 5/2001 | Isaksson et al. | |
| 6,939,197 | B1 * | 9/2005 | Hoeting | 446/437 |
| 7,033,241 | B2 | 4/2006 | Lee et al. | |
| 7,044,826 | B2 * | 5/2006 | Edwards | 446/428 |
| 7,121,917 | B2 * | 10/2006 | Hardouin et al. | 446/470 |
| 7,749,047 | B2 * | 7/2010 | Dunham | 446/470 |
| 2002/0135204 | A1 * | 9/2002 | Okamoto | 296/165 |
| 2008/0261487 | A1 | 10/2008 | Torres | |
| 2009/0149113 | A1 | 6/2009 | Lund et al. | |

* cited by examiner

SELF-RIGHTING MECHANISM FOR A RADIO-CONTROLLED CAR

FIELD

The present invention relates to toy vehicles, and in particular, remote-controlled toy vehicles.

BACKGROUND

Toy vehicles are well-known, and in particular, remote-controlled toy vehicles constitute a significant specialty toy market. In addition to merely being toys, radio-controlled vehicles are often used in organized races on short and long courses, raising the demand for high-quality vehicles with features that will allow the vehicle to be competitive in such races.

Because of the relatively high speeds at which radio-controlled vehicles can travel during races as well as because of the sharply-angled turns of some race courses, the vehicles are prone to over turning, thereby flipping from having their wheels on the ground to having their roof or topside of the vehicle on the ground. Clearly, in the upside down position with its wheels in the air, the vehicle cannot move and needs to be righted before it can continue along the race course. Typically when a vehicle turns over during a race, a person must go over to the car, pick it up, turn it over, and set it down on its wheels so that the vehicle can continue the race. Not only does this require either the person controlling the vehicle or another person to be inconvenienced, but it also takes time to approach and right the vehicle, which may impact the vehicle's position in the race.

SUMMARY

A self-righting mechanism for a toy vehicle is provided, the self-righting mechanism including in one embodiment a base configured to be coupled to the vehicle; an actuator rotatably coupled to the base and extending generally toward a top of the vehicle, the actuator comprising a housing and an actuating rod, wherein the actuator has an inactivated position in which the actuating rod extends a first distance from the housing and an activated position in which the actuating rod extends a second distance from the housing greater than the first distance; an arm rotatably coupled to the base and rotatably coupled to the actuator; and a cartridge containing a pressurized gas coupled to the actuator, wherein the actuator is configured to be moved from the unactivated position and the activated position by the pressurized gas and wherein when the actuator is in the activated state, the arm protrudes from the vehicle.

In one embodiment, when the actuator is in the unactivated position, the arm is within the vehicle and when the actuator is in the activated position, the arm extends outwardly at an angle from the vehicle. Additionally, the self-righting mechanism may further include an electronic valve electrically connected to the cartridge and configured to be activated from a location remote from the vehicle.

In one embodiment, the base comprises a first support leg extending in a first direction and a second support leg extending in a second direction substantially perpendicularly to the first leg. The first support leg and the second support leg may each have a pair of parallel members spaced from each other and the second support leg may have a plurality of openings, each of the openings configured to accommodate a fastener. The actuator and the arm may both be rotatably coupled to the first support leg. Further, a support truss may contact both the first support leg and the second support leg.

DETAILED DESCRIPTION

Figure 1:
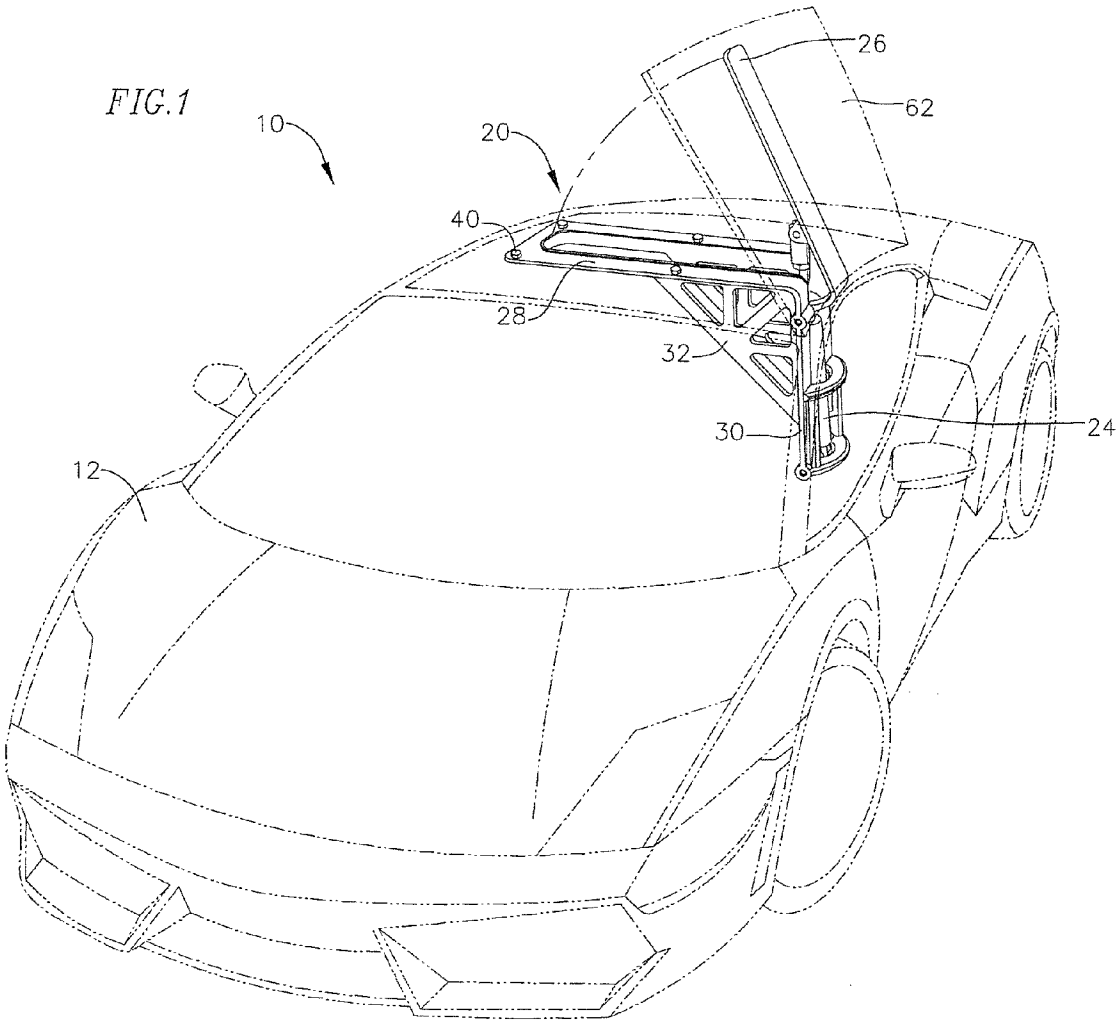
FIG. 1 is a perspective view of an exemplary embodiment of a self-righting mechanism of the present invention installed on a vehicle.

Generally, a toy vehicle 10 is provided as shown in FIG. 1, the toy vehicle being configured with a self-righting mechanism that allows the vehicle to be overturned onto its wheels from a remote location when it is upside down with its roof on the ground. In one embodiment, the self-righting mechanism includes an actuator powered by an activating mechanism, such as a cartridge containing pressurized gas, the actuator being coupled to the body or chassis of the vehicle at one end and to a movable portion of the roof of the vehicle at the other end. As described in more detail below, when activated, the actuator applies a force to the movable portion of the roof such that the movable portion moves away from the vehicle body. Accordingly, if the movable portion is touching the ground, the force will cause the vehicle to turn over such that the wheels of the vehicle can contact the ground.

A typical vehicle to which the self-righting mechanism may be attached includes a chassis and a separate automobile or truck-style vehicle body positioned on the chassis. In one embodiment, the chassis is a conventional off-road, radio control toy vehicle chassis which includes a front portion pivotally coupled with a rear motor portion, as is well known. Centrally located in the vehicle and forming a rear part of the front chassis portion is a housing which contains the electrical circuitry of the vehicle which may be mounted on a PC board. In one embodiment, the electrical circuitry may include a radio receiver portion and a controller portion. The housing may also contain a power source for supplying the vehicle's power, wherein the power source may be removable.

The controller portion of the electrical circuitry is configured to respond to a control signal received from a radio source remote to the vehicle, such as from a radio transmission remote controller. The controller portion is coupled electrically with the self-righting mechanism to permit the controller portion of the circuitry to control operation of the self-righting mechanism.

A drive housing defines a rear portion of the chassis and may be pivotally coupled with the electrical housing. The drive housing contains at least one conventional remote control vehicle reversible motor coupled to at least one of the rear wheels by a suitable gear train. A pair of motors may be provided to drive each of the rear wheels independently or a single motor or a pair of motors geared together may be provided to simultaneously drive both rear wheels. A separate steering actuator is provided on the front chassis portion and through a conventional lineage pivots the front wheels to steer the vehicle in either lateral direction. Although one embodiment of a toy vehicle has been described herein, it will be understood that embodiments of the present invention could be used in any suitable toy vehicle.

The body 12 of the toy vehicle serves to cover most of the components of the vehicle, to generally provide an aerodynamic shape to the vehicle, and sometimes to give the appearance of a well-known car or truck model. As will be appreciated, the body 12 of the vehicle could have one of a variety of different shapes and sizes depending on the type of vehicle chassis and the purpose of the vehicle. In one embodiment, a portion of the roof that contacts the ground when the vehicle is overturned is configured as a movable roof flap 62. The roof flap 62 is hinged to generally be movable with respect to the rest of the roof and, specifically, hinged so that it can be pushed outward away from the rest of the body. In one embodiment, the hinge can be a living hinge, particularly when the body is made from a relatively flexible material, such as molded resin. However, the present invention is not limited to a living hinge and the hinge may be any other type of suitable hinge, such as a barrel hinge. Alternatively, although the flap is described as being a roof flap, the self-righting mechanism does not have to be on the vehicle's roof, but rather may be on any part of the vehicle that contacts the ground when the vehicle is upside down.

Figure 2:
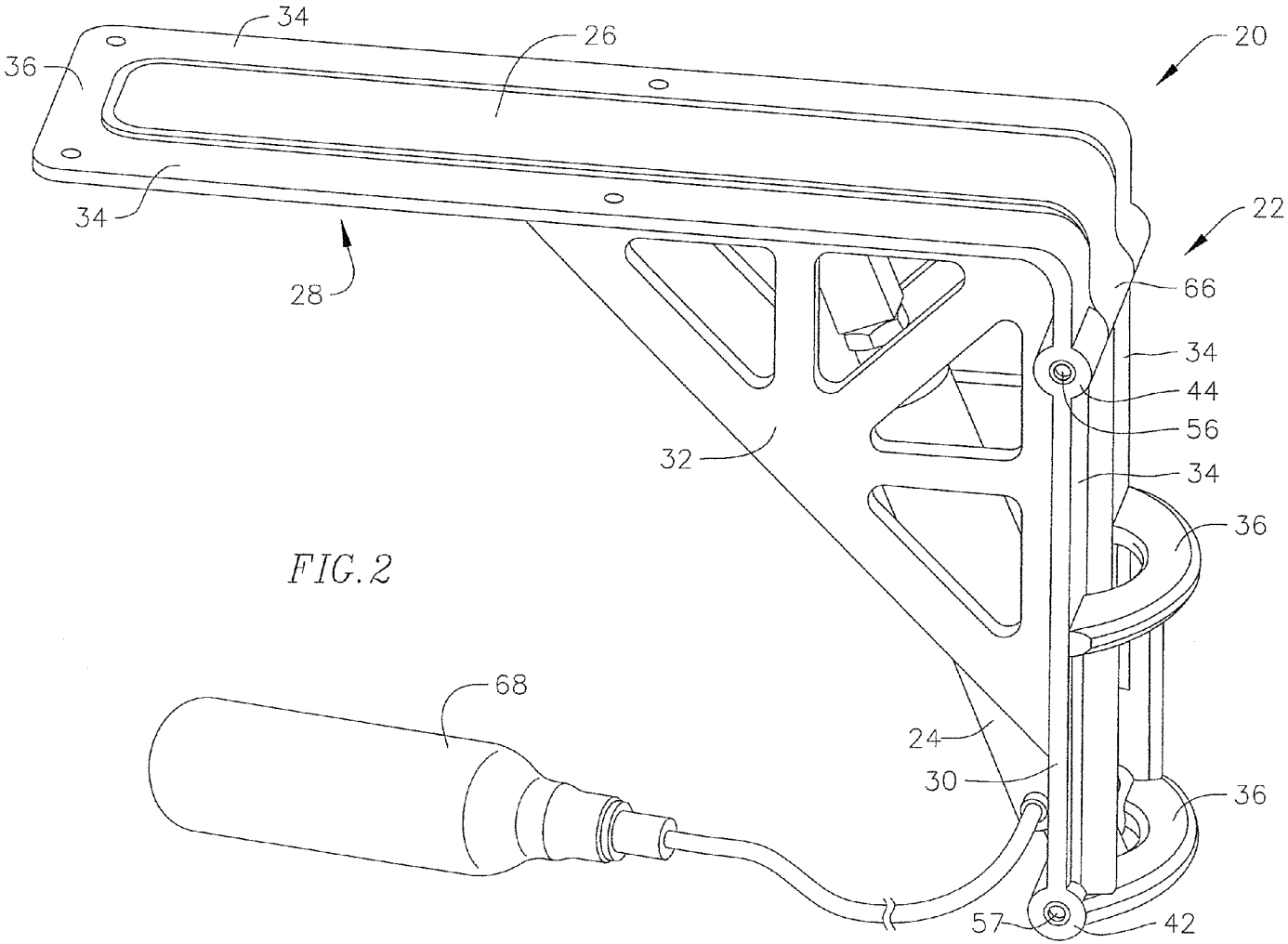
FIG. 2 is a perspective view of the self-righting mechanism of FIG. 1 in the unactivated position.
Figure 3:
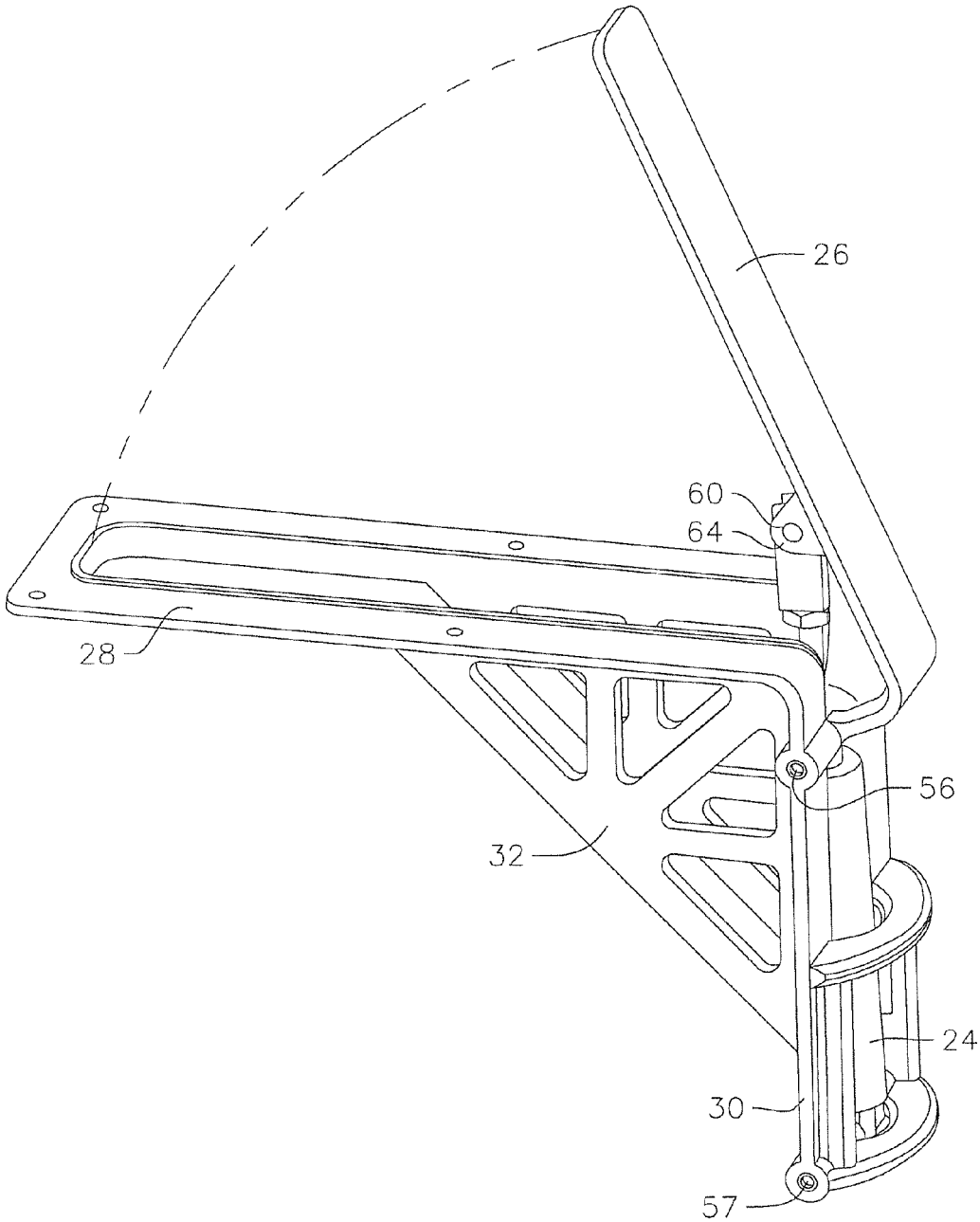
FIG. 3 is a perspective view of the self-righting mechanism of FIG. 1 in the activated position.

With reference now also to FIGS. 2 and 3, a self-righting mechanism 20 according to an exemplary embodiment of the present invention is mounted within the vehicle body and configured to overturn a vehicle that has been flipped onto its roof. The self-righting mechanism includes a base 22, an actuator 24 coupled to the base, and an aim 26 rotatably coupled to the base and to the actuator, wherein when the actuator is activated, the arm rotates with respect to the base to flip the vehicle onto its wheels.

In one embodiment, the self-righting mechanism 20 includes a generally L-shaped base 22 having a roof support leg 28 extending in a first direction and a body support leg 30 extending in a second direction substantially perpendicular to the first direction. The base 22 may be a single integral piece or it may manufactured as multiple pieces and then connected together, such as by welding or by another coupling method. Additionally, the base 22 may include at least one support truss 32 contacting and extending between the roof support leg 28 and the body support leg 30 to provide further support to the base. More specifically, the truss 32 may be generally triangular and located in a corner formed by the roof support leg 28 and the body support leg 30. Further, the truss 32 may be a single continuous plate, a plate with a plurality of openings, or multiple plates welded or otherwise coupled together. In one embodiment, the base 22 may be made from a substantially rigid material, such as a high strength resin plastic, but it will be appreciated that the base is not limited to the materials listed herein, but rather that the base can be made from any suitable rigid material. Additionally, although the base 22 is described as being L-shaped, it will be appreciated that the specific shape of the base is not critical and that the base may have shapes other than those described herein.

In one embodiment, the roof support leg 28 and the body support leg 30 each include two generally elongate and planar parallel members 34 spaced from each other and connected by at least one bridge 36, and in some cases, a plurality of bridges. As shown in FIGS. 2 and 3, the roof support leg 28 has a single bridge 36 extending between the two members 34 at a distal end of the leg (i.e., a free end of the leg as shown in the figures). Additionally, the body support leg 30 has two arc-shaped bridges 36 extending between the members 34, one at a distal end and one about in the middle of the leg. The space between the members is configured to accommodate the actuator 24 and the arm 26, as described in more detail below.

The roof support leg 28, in one embodiment, may have a plurality of openings 38 configured to accommodate fasteners 40 to thereby couple the base 22 to the roof of a vehicle. Specifically, as shown the roof support leg 28 has four openings 38, but it will be appreciated that the number of openings is not limited thereto. The fasteners 40 used to attach the base 22 to the vehicle may be, for example, rivets, nuts and bolts, or screws. Further, the base 22 may be coupled to the vehicle by an adhesive, hot melting or welding, but is not limited thereto, and the base may be coupled to the vehicle on the body support leg 30 instead of or in addition to being coupled on the roof support leg 28.

The body support leg 30 includes two channels 42, 44 each configured to receive a pin. More specifically, a coupling channel 42 is located at the distal end (or lower end, as shown in FIG. 3) of the body support leg 30 and is configured to receive a coupling pin 57 to rotatably couple the actuator 24 to the base 22. A pivot channel 44 is located adjacent the proximal end (or upper end, as show in FIG. 3) and is configured to receive a pivot pin 56 to rotatably couple the arm 26 to the base 22. Both the coupling channel 42 and the pivot channel 44 are substantially cylindrical, define an opening, and extend across a width of the leg members.

Figure 4:
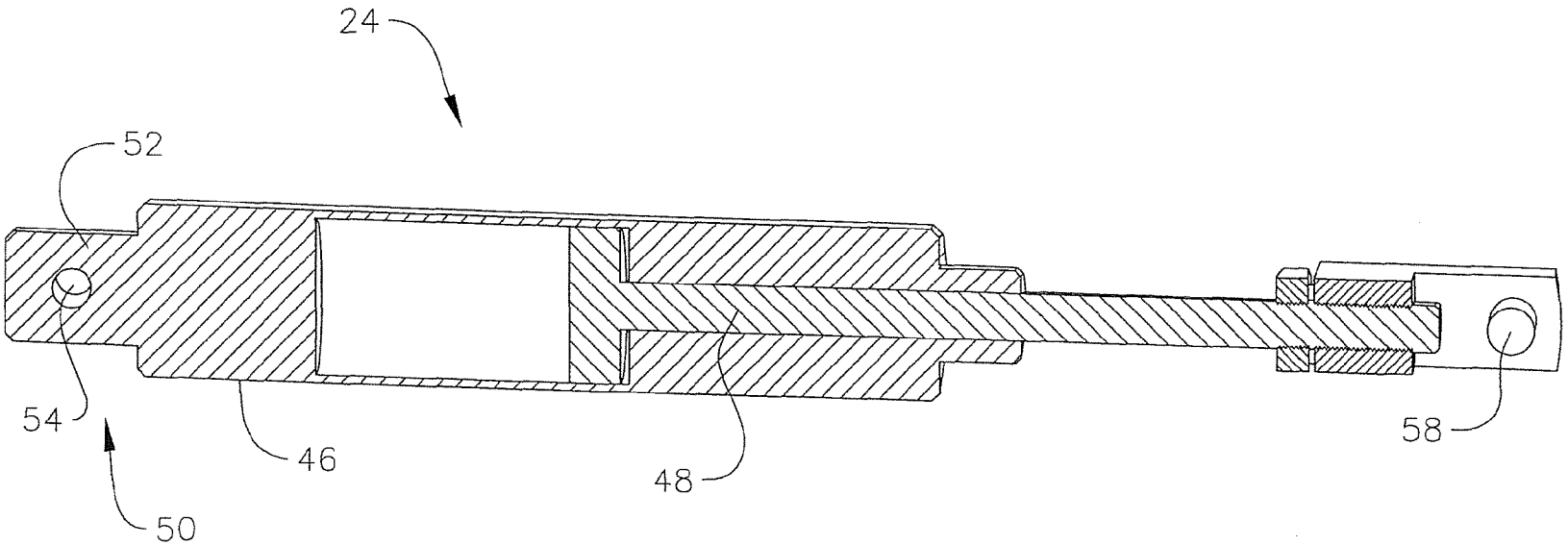
FIG. 4 is a cross-sectional view of an exemplary embodiment of an actuator of the self-righting mechanism of FIG. 1.

In one embodiment, the actuator 24 is rotatably coupled to the base 22 at the coupling channel 42. With reference to FIG. 4, the actuator 24 includes a housing 46 and an actuating rod 48 slidably coupled to the housing. In one embodiment, the housing 46 is substantially cylindrical with a generally hollow interior for accommodating the actuating rod 48, but it will appreciated that the shape of the housing is not limited thereto. An adapter 50 is coupled to one end of the housing, the adapter having a pair of prongs 52 each having an opening 54 configured to accommodate a coupling pin 57. The adapter 50 may be integral with the housing or may be a separate component that is coupled to the housing by, for example, a nut and bolt arrangement or any other suitable coupling. When the actuator 24 is rotatably coupled to the base 22, the actuating rod 48 can be extended from the housing 46 from an unactivated position in which the actuating rod extends from the housing by a first distance (FIG. 2) to an activated position in which the actuating rod extends from the housing by a second distance greater than the first distance (FIG. 3) which causes the actuator to rotate about the coupling pin 57 towards the body support leg 30.

At least a portion of the actuating rod 48 is located within the housing 46 and is configured to slide within the housing. A distal end of the actuating rod 48 (i.e., an end that protrudes from the housing 46) is configured to be coupled to the arm 26 of the self-righting mechanism 20, as described in more detail below. In one embodiment, the distal end includes a protrusion 58 or an opening that can engage an opening 60 or a protrusion, respectively, on the arm to rotatably couple the actuating rod 48 and the arm 26 together. Alternatively, both the arm 26 and the actuating rod 48 can have openings that can be aligned and then coupled together by, for example, a pin. By being coupled together, when the actuating rod 48 is actuated and pushed out of the housing, the rod can force the arm 26 against the ground and thereby flip an overturned vehicle over onto its wheels. More specifically, the actuating rod 48 is attached at an off-center location of the arm 26 so that in the activated position the arm extends outward from the vehicle at an angle to thereby rotate the car back onto its wheels rather than merely push it straight up into the air.

With reference again to FIG. 2, a cartridge 68 filled with a pressurized gas, such as carbon dioxide or air, but not limited thereto, is coupled to the actuator 26, and more specifically to the housing 46. The cartridge 68 may be coupled directly to the actuator or through pneumatic hoses or tubes 70. The cartridge 68 is controlled by an electronic valve powered by the battery used to drive and steer the vehicle and which is connected to the vehicle's receiver for remote operation. An operator can toggle a switch on the controller to activate the valve and thereby release pressurized gas from the cartridge 68 into the housing 46 to actuate the actuator 24.

As shown in FIGS. 2 and 3, the arm 26 is made from a substantially rigid material and is configured to be rotated between an inactivated position and an activated position. In one embodiment, the arm 26 is substantially L-shaped and is located in the gap between the members 34 of the roof support leg 28 and the body support leg 30. Further, the aim 26 may have a planar top surface that can rest on or be adjacent to the roof flap 62 on the vehicle, the roof flap being hinged on one side so that it can be moved with respect to the rest of the vehicle roof. In one embodiment, the roof flap 62 is hinged by a living hinge, but it will be appreciated that any hinged could be used to allow the roof flap to be rotatable. As described in more detail below, when the arm 26 is forced against the roof, the arm pushes the roof flap 62 so that the roof flap "opens" and allows an overturned car to be flipped onto its wheels.

In an alternate embodiment, the roof flap 62 is omitted and the arm 26 acts directly on the ground to flip the car over. In other words, the roof of the vehicle may have an opening generally sized to accommodate the aim 26, while the roof support leg 28 may still be attached to the roof.

The arm 26 has connecting tabs 64 extending from a lower surface to provide an area to rotatably couple the arm to the actuating rod 48 of the actuator 24. Specifically, in one embodiment the arm 26 has two connecting tabs 64 spaced from each other and each having an opening 60 configured to receive a portion of the actuator. In one embodiment, the connecting tabs 64 are located at a distance from the body support leg 30 so that the actuator 24 extends at an angle away from a side of the vehicle. Specifically, the angle of the actuator may be between about 10 degrees to about 35 degrees with respect to the vertical, but it will be appreciated that the present invention is not limited to this range of angles.

The arm 26 also has a pivot channel 66 to accommodate the pivot pin 56 to rotatably couple the arm to the base 22. Although the arm 26 is shown in the figures as having an L-shape wherein the pivot channel 66 is located on the short portion of the "L," it will be appreciated that the arm could also have other shapes, such as being linear, wherein the pivot channel could be located at or proximate to an end of the linear arm.

An operation of the self-righting mechanism 20 will now be described. When the vehicle is right-side up on its wheels, the actuator 24 will be in its unactivated position, i.e., the actuator rod 48 will be mostly within the housing 46 so that the roof flap 62 is substantially flush with the rest of the roof. If the vehicle is overturned so that it is upside-down on its roof, the operator can activate a switch on the radio controller to activate the self-righting mechanism 20. Specifically, activating the switch will trigger an electronic valve, thereby causing the cartridge 68 to release pressurized gas into the housing 46 of the actuator 24. Accordingly, the actuating rod 48 will extend further from the housing into the activated position, thus pushing the roof flap 62 against the ground and forcing the vehicle to turn over onto its wheels. As noted above, activating the actuator 24 to eject the actuating rod 48 from the housing 46 causes the arm 26 to rotate about the pivot pin 56 and also causes the actuator to rotate about the coupling pin 57. Accordingly, neither the operator nor any other person has to go over to the vehicle and manually turn the vehicle over, saving time and effort. Once the vehicle has been righted, the actuating rod 48 is biased to return to the unactivated position, such as by a spring. Alternatively, the actuating rod can return to the unactivated position by gravity.

The self-righting mechanism according to exemplary embodiments of the present have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A self-righting mechanism for a toy vehicle, the self-righting mechanism comprising:

a base configured to be coupled to a roof of the vehicle;

an actuator rotatably coupled to the base and extending generally toward a top of the vehicle, the actuator comprising a housing and an actuating rod, wherein the actuator has an inactivated position in which the actuating rod extends a first distance from the housing and an activated position in which the actuating rod extends a second distance from the housing greater than the first distance;

an arm rotatably coupled to the base and rotatably coupled to the actuator; and a cartridge containing a pressurized gas coupled to the actuator, wherein the actuator is configured to be moved from the inactivated position and the activated position by the pressurized gas and wherein when the actuator is in the activated position, the arm protrudes from the vehicle.

2. The self-righting mechanism of claim 1, wherein when the actuator is in the inactivated position, the arm is within the vehicle and when the actuator is in the activated position, the arm is configured to extend outwardly at an angle from the vehicle.

3. The self-righting mechanism of claim 1, further comprising an electronic valve electrically connected to the cartridge and configured to be activated from a location remote from the vehicle.

4. The self-righting mechanism of claim 1, wherein the base comprises a first support leg extending in a first direction and a second support leg extending in a second direction substantially perpendicularly to the first leg.

5. The self-righting mechanism of claim 4, wherein the actuator and the arm are both rotatably coupled to the first support leg.

6. The self-righting mechanism of claim 4, further comprising a support truss contacting both the first support leg and the second support leg.

7. The self-righting mechanism of claim 4, wherein the second support leg has a plurality of openings, each of the openings configured to accommodate a fastener.

8. The self-righting mechanism of claim 7, wherein the fastener comprises a rivet, a screw, or a nut and bolt.

9. The self-righting mechanism of claim 4, wherein the first support leg and the second support leg each comprise a pair of parallel members spaced from each other.

10. The self-righting mechanism of claim 9, wherein the arm is between the pair of members of the first support leg and the second support leg.

11. The self-righting mechanism of claim 1, wherein the actuator is rotatably coupled to the base by a pin.

12. The self-righting mechanism of claim 1, wherein the arm is rotatably coupled to the base by a pin.

13. The self-righting mechanism of claim 1, wherein the arm has a pair of connecting tabs each having an opening to accommodate a distal end of the actuating rod.

* * * * *

UNITED STATES PATENT AND TRADEMARK OFFICE

CERTIFICATE OF CORRECTION

PATENT NO. : 8,974,265 B2
APPLICATION NO. : 13/429055
DATED : March 10, 2015
INVENTOR(S) : Matthew S. Wallace It is certified that error appears in the above-identified patent and that said Letters Patent is hereby corrected as shown below:

On the Title Page

Item (73) Assignee Delete "D.T. Mattson Enterprises, Inc.,",

Insert --D.T. Mattson Enterprises, Inc. dba Pro-Line Racing,--

Signed and Sealed this
Fourteenth Day of June, 2016

Michelle K. Lee

Michelle K. Lee
*Director of the United States Patent and Trademark Office*